US005658478A

United States Patent [19]

Roeschel et al.

[11] Patent Number: 5,658,478

[45] Date of Patent: Aug. 19, 1997

[54] AUTOMATIC HEATING ASSEMBLY WITH SELECTIVE HEATING

[76] Inventors: Hans E. Roeschel, 10795 Hammerly S. 300, Houston, Tex. 77043; Dalibor Satrapa, Lackierergasse IA/II, A-1090 Wien, Austria

[21] Appl. No.: 237,273

[22] Filed: May 3, 1994

[51] Int. Cl.[6] ..... H05B 1/02

[52] U.S. Cl. ..... 219/502; 219/506; 219/518; 219/665; 219/704

[58] Field of Search ..... 219/502, 506, 219/497, 494, 665, 660, 661, 702, 711, 518, 625, 626

[56] References Cited

U.S. PATENT DOCUMENTS

| | | | |
|---|---|---|---|
| 3,719,789 | 3/1973 | Harnden, Jr. | 219/10.49 |
| 3,887,781 | 6/1975 | Peters, Jr. | 219/10.49 |
| 4,278,870 | 7/1981 | Carleton et al. | 219/219 |
| 4,435,637 | 3/1984 | de Vries | 219/358 |
| 4,499,368 | 2/1985 | Payne . | |
| 4,876,435 | 10/1989 | Hawkins | 219/364 |
| 5,136,277 | 8/1992 | Civanelli et al. . | |
| 5,138,135 | 8/1992 | Husslein et al. . | |
| 5,155,338 | 10/1992 | Hoffmann . | |
| 5,223,697 | 6/1993 | Wilde et al. . | |
| 5,243,172 | 9/1993 | Hazan et al. | 219/518 |
| 5,369,252 | 11/1994 | Kondo | 219/704 |

*Primary Examiner*—Mark H. Paschall
*Attorney, Agent, or Firm*—Sankey & Luck, L.L.P.

[57] ABSTRACT

An automatic burner assembly is disclosed, which assembly is adapted to be automatically and selectively actuatable upon the placement of a given vessel thereon or in close proximity thereto, this assembly comprising a heating element operably coupled to a sensor assembly, where this assembly is capable of detecting the presence of a given vessel on or proximate to the heating element.

29 Claims, 5 Drawing Sheets

FIG. 3
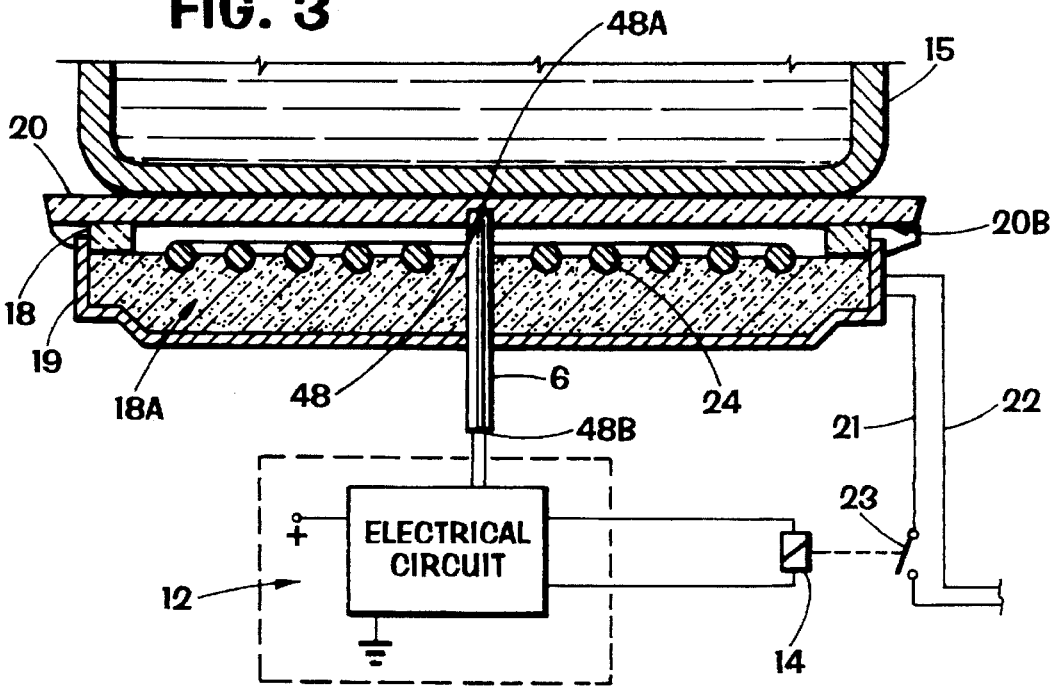
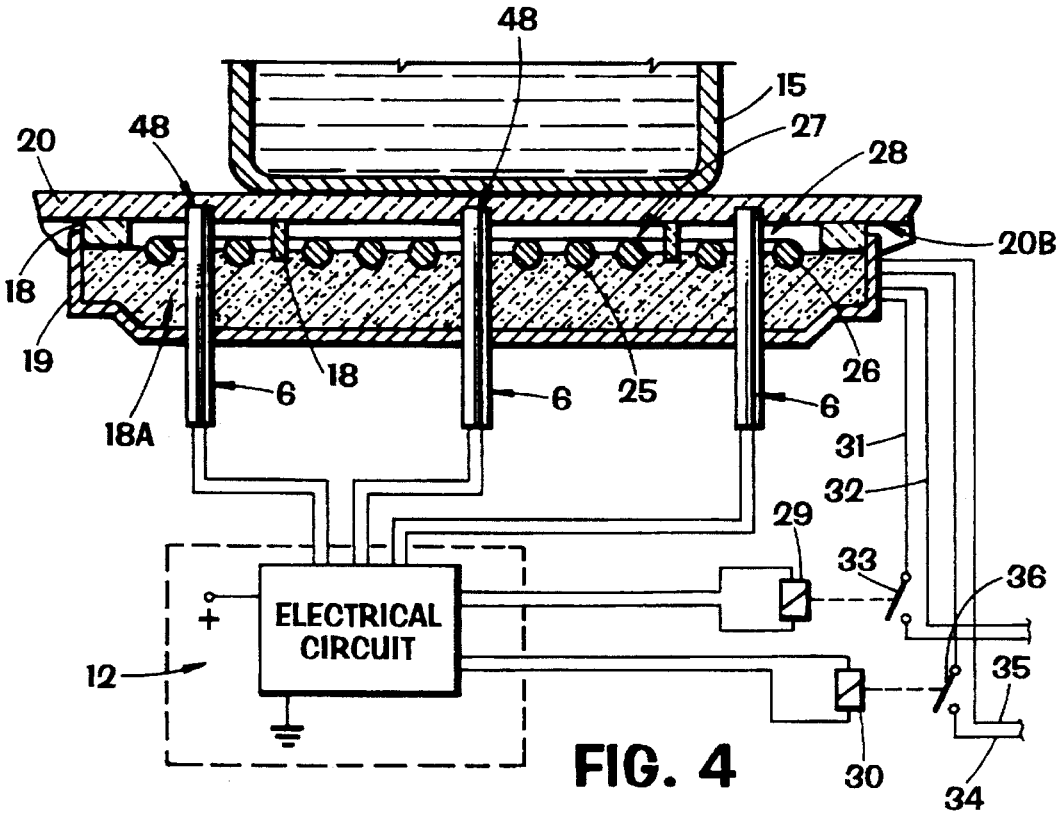
FIG. 4

FIG. 5
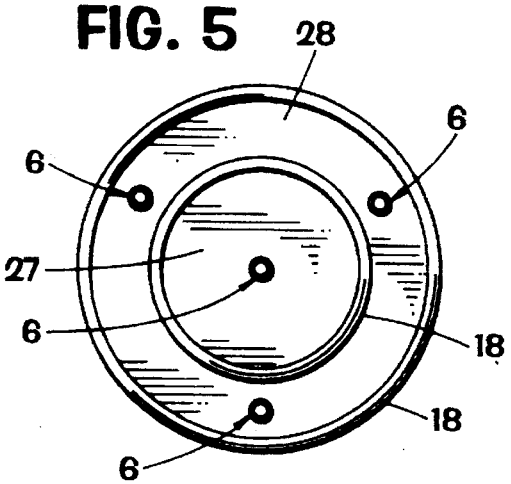
FIG. 6
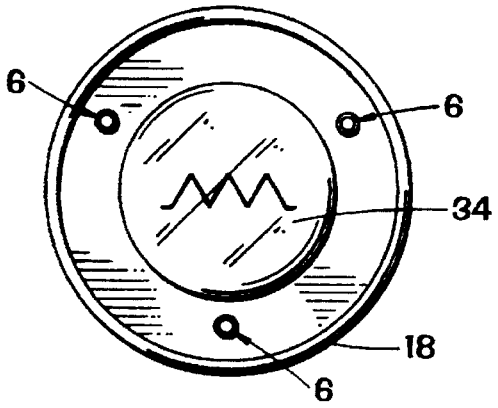
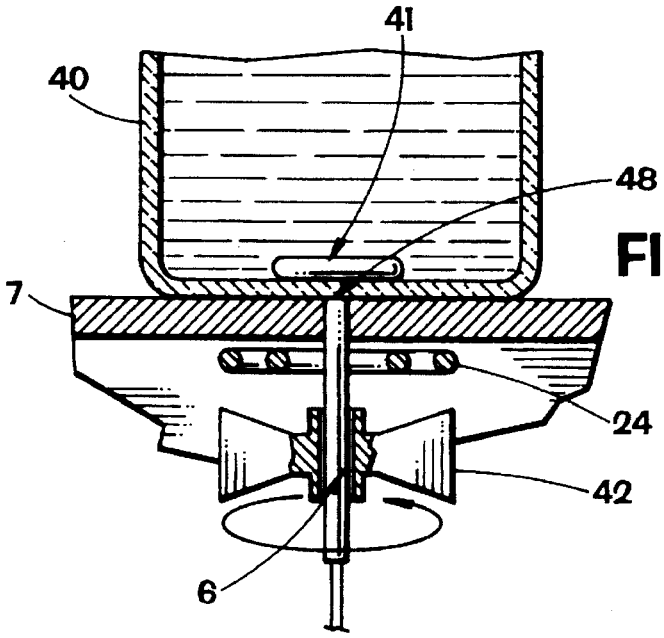
FIG. 7
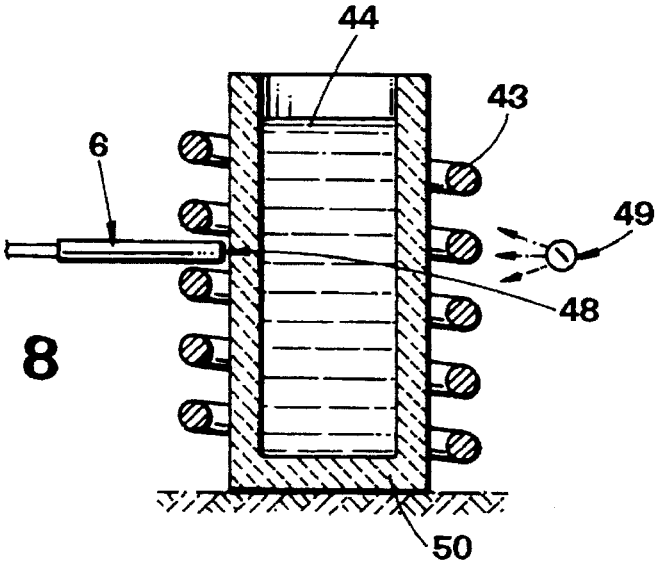
FIG. 8

AUTOMATIC HEATING ASSEMBLY WITH SELECTIVE HEATING

BACKGROUND OF THE INVENTION

1. Field of the Invention

The present invention is generally directed to heating and cooking elements and means for automatically controlling their operation. More specifically, the present invention is directed to heating assemblies having an selective heating geometry with automatic on/off control.

2. Description of the Prior Art

Oven top and stove type heating elements have been traditionally arranged in a group about a planar heating surface. Most commonly, these elements have included electric resistor type heating elements or natural gas heating elements arranged in groups of two or four about a cooking surface. These elements are generally manually actuated between an on/off position and include incremental temperature controls operable by the operator via a switch situated on or about the cooking surface.

The configuration, placement and operation of such traditional heating and cooking elements, however, has a number of disadvantages. One such disadvantage is the limitation on the number of cooking vessels which may be located atop the cooking surface at any one time. In conventional embodiments, the number of vessels, e.g. pots, cannot exceed the number of heating elements and thus require that large meals involving cooking pots in excess of the number of heating elements be completed in a staggered fashion.

Furthermore, the geometry of conventional heating elements often present a handicap to the user since the heating element or burner is often too small and sometimes too large for a given cooking vessel, thereby resulting in a uneven or incomplete heating in the instance of a small burner, or in a waste of energy when the burner is overly large. Additionally, conventional heating elements are most often circular in configuration, thus restricting their ready adaptation to square or elongated cooking vessels.

Finally, traditional heating and cooking elements and the ranges or cooktops into which they are incorporated do not utilize any procedures to avoid energy waste when not in use. Accordingly, it is possible for a burner to remain "on" long after the cooking vessel is removed, thereby presenting a fire hazard. Moreover, oftentimes the user incorrectly actuates a given heating element, again resulting in energy waste and prolonging the cooking process.

SUMMARY OF THE INVENTION

The present invention addresses the above and other disadvantages of prior art heating elements and their application to a cooktop or stove surface. As illustrated below, the present invention also offers benefits and advantages to various industrial and commercial applications.

The present invention in one embodiment is generally comprised of one or more heating elements arranged in a planar arrangement about a cooking surface, and means to automatically actuate said element(s) upon the placement of a given cooking vessel on an individual element. In a preferred embodiment, light sensing means are incorporated below or into the stove surface proximate to each element to detect the presence of a given vessel, and if such presence is detected, to actuate the heating element under that particular vessel for the period of time it remains on the element. When the vessel is removed, the light sensor then deactivates the heating element.

Other embodiments of the present invention contemplate the use of a heating grid, e.g., an arrangement of independently actuatable heating elements, which may be selectively actuated in the manner described above to accommodate a vessel of any given size or configuration. In such a manner, energy use is optimized.

The present invention has a number of advantages over the art. One such advantage is the ability to reduce energy waste through the selective use of heating elements which are automatically actuated only upon a disturbance in the continuity of a light or energy beam. In such a fashion, fire hazards created as a result of inadvertent and unattended use of such heating elements are minimized.

A second advantage of the present invention in the context of domestic applications is the ability to utilize a number of different cooking vessels on a given cooking surface at any given time where the number of said vessels is limited only by the total surface area of the cooking surface.

Yet a third advantage of the present invention is the ability to conform the geometry of a heated surface to a given vessel, thereby again resulting in energy savings.

BRIEF DESCRIPTION OF THE DRAWINGS

FIG. 1 includes multiple views in which

FIG. 3 illustrates a cross-sectional view of a related embodiment of the invention incorporating an electrical, resistor type heating element in relation to an light sensor assembly.

FIG. 4 illustrates a cross-sectional view of yet another related embodiment of the invention as utilized in conjunction with a plurality of electrical heating elements.

FIG. 5 illustrates a top view of a conventional electric heating element which has been modified to incorporate automatic sensor means.

FIG. 6 illustrates a top view of a halogen heating element which has been modified to incorporate the automatic sensor means of the present invention.

FIG. 7 illustrates a second embodiment of the present invention in relation to a stirring assembly.

FIG. 8 illustrates yet another embodiment of the present invention in relation to an industrial, induction-type heating assembly.

FIG. 10 includes multiple views in which

DETAILED DESCRIPTION OF THE PREFERRED EMBODIMENT

The automatic heating assembly of the present invention includes, in a general embodiment, a heating element arranged about a planar cooktop surface where said element is provided with means to automatically actuate the element upon placement of a cooking vessel, e.g., a pot, thereon. As will be illustrated below, the present invention though primarily described in relation to cooking applications, also has application to a variety of other applications in which automatic actuation and/or selective heating is required.

Figure 2:
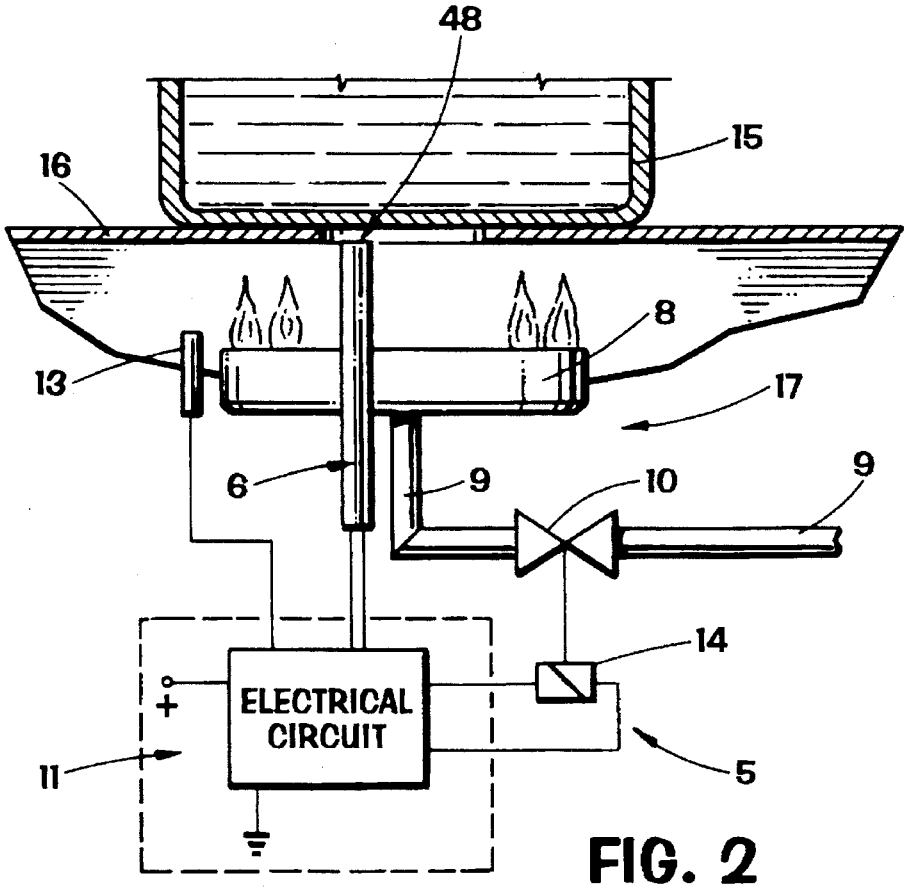
FIG. 2 illustrates a cross-sectional view of one embodiment of the invention including a natural gas heating element and an light sensor assembly.

FIGS. 2–4 illustrate a plurality of embodiments incorporating the present invention for application and incorporation into conventional cooking surfaces. FIG. 2 illustrates a range top 16 beneath which is disposed a natural gas heating assembly 17 which includes, in a conventional embodiment, a burner 8, a feed line 9 including a cut off valve 10, and a generator and flame detection device 13. Integrated into heating assembly 17 is an automatic actuation means 5 which comprises a light sensor assembly 6 operatively coupled to an electrical circuit 11 and switching device 14 in the manner illustrated in FIG. 2.

Circuit 11 may be constructed in accordance with conventional teachings as a bridge, a microprocessor or the like. Electrical circuit 11 controls the operation of spark generator 13 and switching device 14, e.g., a relay, such as to operate valve 10, e.g., a solenoid valve, between an "on" and an "off" position. It is also envisioned that electrical circuit 11 may also control fuel flow through feed line 9 by controlling the operation of a regulating valve (not shown) connected in series to feedline 9 in accordance with preset or input values.

Sensor assembly 6 is envisioned to operate in an environment where it receives a minimum amount of light from a given source when it is in a non-actuated mode. When this light source is removed, interrupted or reduced such as, for example, when a pot 15 is placed atop assembly 17 between assembly 6 and the light source, assembly 17 is then actuated. More specifically, assembly 17 is actuated by the placement of the cooking vessel 15, over assembly 17 which modifies the light signal received by assembly 6. This signal is sensed by electrical circuit 11 and compared to a preset, threshold value. As the signal passes the preset value, the electrical circuit 11 operates switching device 14 which opens solenoid valve 10 and activates spark generator and flame detection device 13. The intensity of the heat generated by burner 8 can then be modulated by the operator in a conventional fashion.

The removal of vessel 15 from assembly 17 results in an increase in the amount of light entering assembly 6 and therefore a fluctuation in the electrical output signal generated thereby. This fluctuation is again detected by circuit 11 which, after reaching the preset threshold value, causes circuit 11 to activate switching device 14 to close valve 10.

Figures 1A, 1B, 1C:
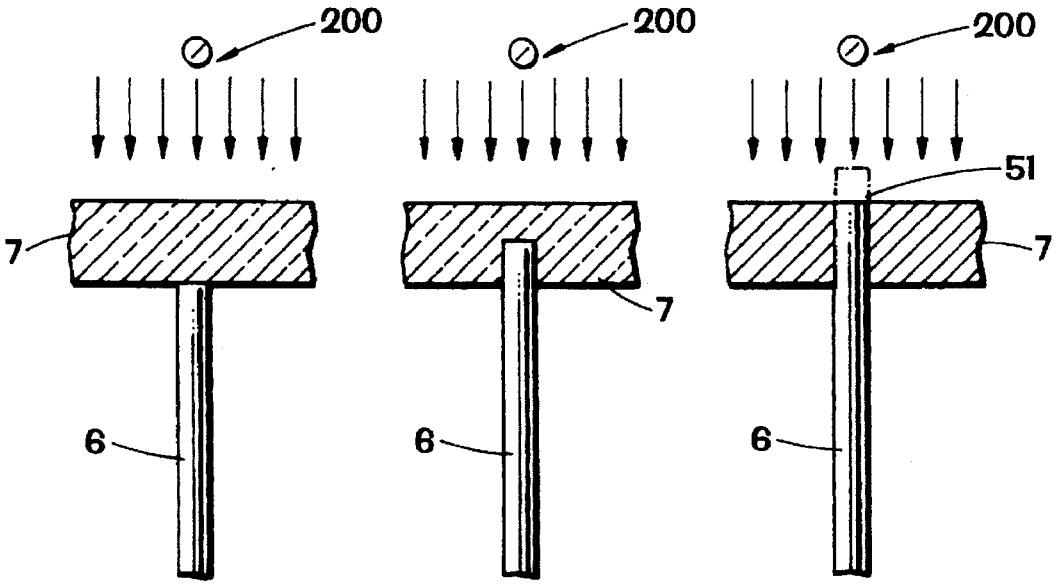
FIGS. 1A–C illustrate the placement of a light sensing element proximate to a heating element.

By reference to FIG. 1A–C, sensor assembly 6 in one aspect may be positioned below cooking surface 7 when it is constructed from transparent materials such as a glass or other transparent or translucent materials, e.g., a glass or ceramic. Alternatively, assembly 6 may be integrated into or even extend nominally above cooking surface 7 in the manner illustrated in FIG. 1B–1C, in the occasion when cooking surface 17 is opaque or nominally translucent. In the example illustrated in FIG. 1C, assembly 6 may be disposed within a hole or aperture 51 defined in surface 7. In the embodiment illustrated in FIG. 11, it may be desirable to employ a transparent top cover to avoid damage or blockage created by food particles or the like about sensor assembly 6.

Figure 11A:
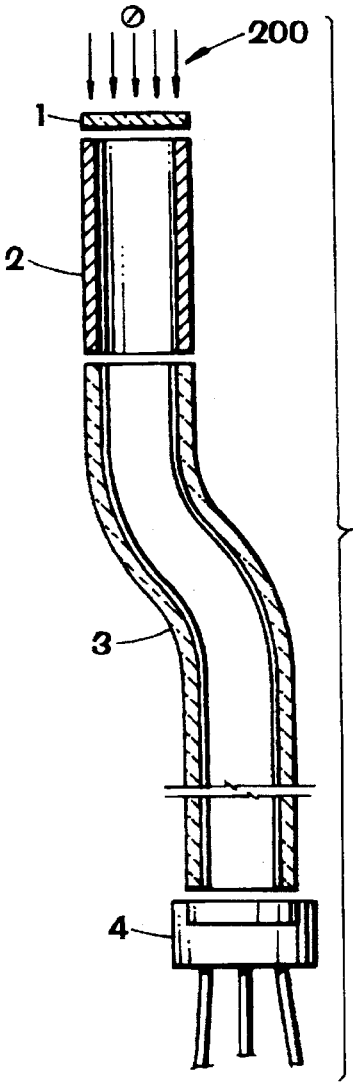
FIG. 11 includes multiple views in which FIGS. 11A–B diagrammatically illustrate one embodiment of the light sensor assembly.
Figure 11B:
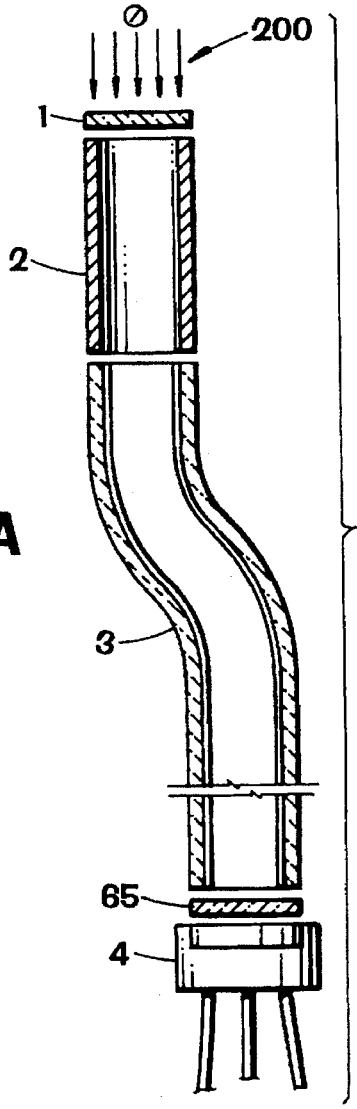

In the embodiment illustrated in FIG. 1 and more specifically in FIG. 11, it is desirable that sensor assembly 6 be receivable to the incidence of light generated by a given light source 200 which may constitute an overhead range light, an ultraviolet light source, or natural light. In the embodiment illustrated in FIG. 11, sensor assembly 6 comprises at least one light guide 2 or 3 and a light sensor 4. Light guide 2 may be formed of a hollow tube. Alternatively, guide 2 may constitute a bore formed in a suitable material, e.g., a ceramic or ceramic compound. Still alternatively, light guide 2 may comprise a fiber optic carrier. If necessary in selected applications, a transparent cover or cap 1 may be added to the uppermost portion of guide 2, where such cap may be manufactured from a polymer, glass, glass ceramic, fused silica, diamond or the like. Light guide 2 (and/or 3) functions to transfer incident light 200 to light sensor 4.

Light sensor 4 is preferably located in a sufficiently lower temperature portion of sensor assembly 6 and may therefore comprise any type of transducer capable of transforming light signals 0 into electrical signals, e.g., a photo resistor, photo diode, solar cell, photo transistor, photothyristor, video camera or the like. In this connection, it may be desirable to locate sensor assembly 6 remotely from the top portion of the light guide 2 (or 3) in a thermally insulated area. In operation, light 0 entering sensor 6 through guide 2 or 3 is channeled to detector 4 where the light input is transformed into an electrical output signal. To ensure a good ratio of signal, e.g., the light change related to the placing or removal of a given vessel to noise, it is desirable to include a light detector 4 having a peak spectral response at low wavelengths of 800 nm or less. For high temperature heating it may be necessary to employ a suitable light filter 5 which transmits only light of short wavelengths.

It is envisioned that it may be desirable for sensor assembly 6 to integrally include a light source and a sensing element such that a given heating element can be actuated by the amount of backscattered light generated by said light source upon contact with a pot 15 and received by said assembly 6. This embodiment may have application where a ready or adequate light source is unavailable or in instances where more precise actuation is desired.

In order to prevent the unintended operation of a burner by, for example, placing miscellaneous items on a surface, it may be desirable to include within circuit 11 contactors (not shown) which can be set by the operator to allow interruption of the sensing of an electrical output signal of each sensor assembly 6 for each element so as to allow the heating assembly to be used as a conventional range. In order to prevent the unintended operation of an exemplary gas burner 8 by a significant decrease of the room light, i.e., by switching off or dampening the light in the room in which the cooking surface is located, electrical circuit 11 preferably includes at least one room light detector (not shown) constructed in accordance with conventional teachings and located outside of the heating zone. This detector would automatically interrupt the sensing of the electrical output signal of the light sensor assembly 6 by the electrical circuit 11 and shut down all burners (unless the burners are run in a conventional manner by the operator) if the room light falls below a preset minimum value which should be selected correspondingly to the present threshold value. Moreover, this minimum value should be selected correspondingly to the preset threshold value to which the electrical output signal of the light sensor assemblies 6 is compared by the electrical circuit 11.

FIGS. 3 and 4 illustrate another application of the invention to a range top incorporating, in the instance of FIG. 3, a singular resistor-type heating element 24, and in FIG. 4, a plurality of resistor-type heating elements 25 and 26. Referring to FIG. 3, heating element 24 may adopt, in a conventional embodiment, a spiral-type resistor and be disposed beneath a transparent or translucent cooking surface 20 via insulators 18. As noted, surface 20 may be formed of a transparent or translucent glass, ceramic or other materials having similar properties. Heating element 24 is disposed within a containment cup 19 about an insulated matrix 18A. Element 24 is operatively coupled to a power source (not shown) via leads 21 and 22 in which a contactor 23 is operably disposed responsive to a switching device 14.

As illustrated, light sensor assembly 6 is disposed in an upright fashion through heating element 24, cup 19 and matrix 18A to define an upper end 48 and a lower end 48A. Upper end 48 of assembly 6 is embedded in cooking surface 20 so as to be receptive to a light source (not shown) directed to a selected receptive horizon thereabove. As noted, light source may include a range top light or another light source specifically adapted for this purpose. Sensor assembly 6 is coupled at its lower end to a electrical circuit 12, such as that previously described, which circuit 12 is coupled to switching device 14. In operation, sensor assembly 6 monitors light in a selected optical field above element 24. When such light falls below a selected value, as, for instance, when a pot 15 is placed atop element 24, sensor assembly 6 through circuit 12 engages switching device 14 to actuate element 24. Again, the operator may modulate the intensity of heat generated by element 24 through conventional panel controls. Moreover, it may be desirable to include within range top an optical indicator to alert the operator that a given element 24 has been actuated.

FIG. 4 illustrates a modification of the embodiment illustrated in FIG. 3 incorporating a plurality of heating elements 25 and 26 in cooperation with a like number of sensor assemblies 6. The electrical connection between assemblies 6 and elements 25 and 26 is essentially a modification of that previously described above with reference to FIG. 4, except that by use of two switching devices 29 and 30 each heating element 25, 26 may be actuated independently. In such a fashion, a large pot 15 may solely actuate a single heating element or both heating elements depending on its position relative to sensor assemblies 6. Hence, energy savings may be observed.

FIGS. 5 and 6 illustrate the potential placement of light sensor assemblies 6 in relation to a resistor-type burner 18 and a halogen-type lamp heat source 34. As illustrated, it may be desirable to incorporate a number of sensor assemblies 6 within both concentric rings 28 and 29 of the resistor-type heating element illustrated in FIG. 5 such that if a given cooking vessel is not of sufficient diameter to block incident light from the sensor assemblies 6 placed in the outer ring 28, only the inner ring is actuated, thereby again resulting in energy savings. As illustrated in FIG. 6, it may be desirable to place a number of sensor assemblies 6 symmetrically around a given heat source 34 to ensure actuation only when a given pot is aligned directly atop the burner itself.

Figure 9:
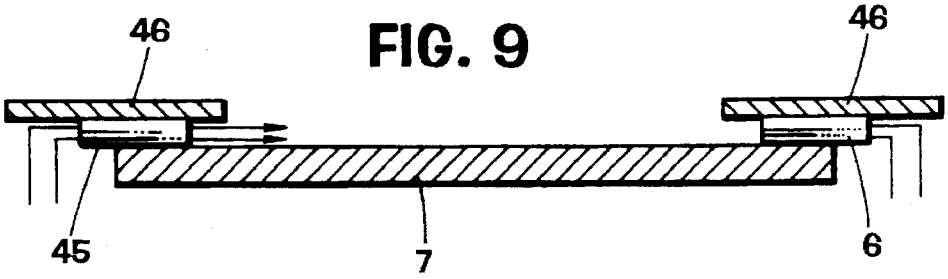
FIG. 9 illustrates a cross-sectional view of an alternate placement of the automatic sensor means of the present invention vis-a-vis a cooktop.

FIG. 9 illustrates another embodiment of the present invention with respect to the placement of a sensor assembly 6 vis-a-vis a given cooking surface 7. As illustrated, it may be desirable in some applications, and especially in applications where surface 7 is opaque, to incorporate sensor assemblies 6 such that they detect are capable of lighting projected from a selected source 45 horizontally over surface 7. Sensor assemblies 6 and light projector 45 may be incorporated beneath a lip or covering 46 for purposes of protection as well as for purposes of aesthetics.

Figure 10A:
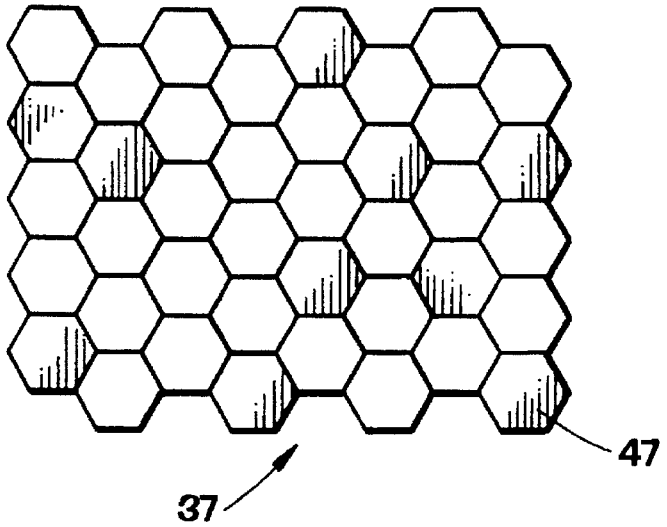
FIGS. 10A–C illustrate the topical orientation of tessellatingly arranged modular heating elements of yet another embodiment of the invention.
Figure 10B:
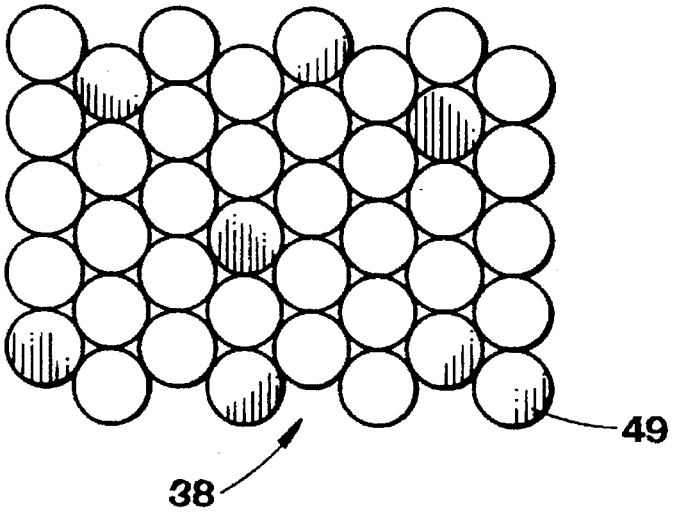
Figure 10C:
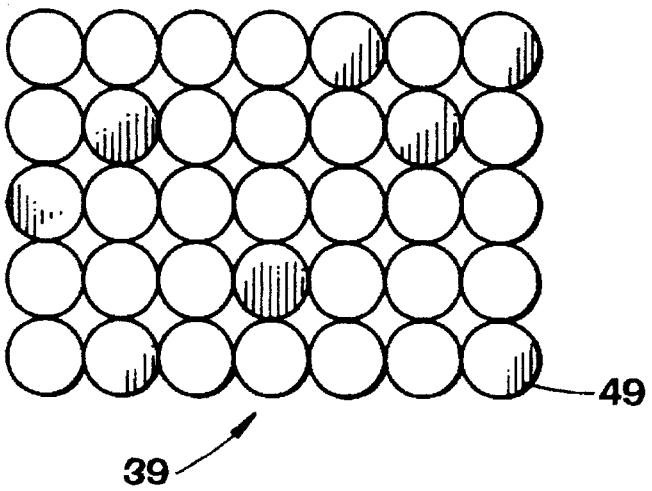

FIGS. 10A–C illustrate yet another embodiment of the present invention in which a given heatable surface, e.g., a planar cooktop, is comprised of a plurality of densely arranged, independently heatable modules or elements 47. As illustrated in FIG. 10, these modules or elements may adopt a variety of geometrical configurations, the object being to form a uniform heating field. In the illustrated embodiment, these elements 47 are tessellatingly arranged to form a gapless heating grid. In one aspect of this embodiment, each element 47 is provided with an light sensor and actuation circuitry such as that previously described in relation to the aforedescribed embodiments. In such a fashion, the field can be heated to a selected size and shape depending on the number of elements 47 covered by a given vessel, thereby allowing uniform heating of a dish or pan of an irregular or unusual configuration. Alternately, it is envisioned that each element may be provided with manual, automatic or preprogrammed means of actuation.

Yet another application of the present invention may be seen by reference to FIGS. 7 and 8. FIG. 7 illustrates a container or vessel 40, preferably a non-magnetized vessel such as a glass beaker, disposed over a heating element 24 about a surface 7. In the illustrated embodiment, a conventional automatic stirring assembly 42 is disposed below a heating element 24, e.g., a resistor-type heating element, which assembly 42 being cooperable with a magnetic stirring element 41. An automatic sensor assembly 6 is situated below vessel 40 and electrically coupled in a fashion similar to that earlier described in relation to other embodiments such that when vessel 40 is placed over heating element 24, element 24 and stirring assembly 42 may be automatically actuated. Since laboratory beakers and their contents are frequently transparent, the resulting change of incoming light received in light entrance 48 of sensor assembly 6 may be comparatively small. It may therefore be desirable to situate assembly 6 in a recessed aperture about surface 7 so as to enhance the sensitivity thereof. This light change can be increased and therefore the detectability of the beaker improved if the uppermost portion 48 of sensor assembly 6 can be aligned with the axis defined by the magnetic field generated by assembly 42 and therefore caused by the usually non-transparent stirring body 41.

FIG. 8 illustrates yet another embodiment of the present invention wherein a sensor assembly 6 is disposed within the coil of an induction type heater 43, e.g., for melting inductively coupling material 44 in a ceramic vessel 50. Sensor assembly 6 detects the placement of the vessel 50 into the induction heater 43 by the fluctuation of the incoming light into its upper end 48 and actuates heater 43 in a previously described manner. Therefore, energy is saved as heater 43 is automatically powered only when needed.

Although particular detailed embodiments of the apparatus of the present invention have been described herein, it should be understood that the invention is not restricted to the details of the preferred embodiments. Many changes in design, composition, configuration and dimension are possible without departing from the spirit of the instant invention.

What is claimed is:

1. An automatic heating assembly comprising:

one or more heating elements arranged about a planar cooking surface where each element defines an upper and a lower surface, where said heating elements are operatively coupled to a sensor assembly and a power means;

said sensor assembly disposed beneath to said surface so as to be receivable to illumination at a first intensity from a light source disposed above and directed through the cooking surface and over the top surface of said heating elements in a first condition and at a second intensity when an object is placed on one or more of the elements, where said sensor assembly automatically actuates said heating elements when illuminated by light at said second intensity.

2. The assembly of claim where said second intensity is less than said first intensity.

3. The assembly of claim 1 further including a light source disposed above said surface such as to illuminate the upper surface of said heating elements.

4. The assembly of claim 1 wherein said sensor assembly is operably coupled to said power means via on/off circuitry such that when said sensor assembly detects a fluctuation in the intensity of the light source the heating elements are automatically actuated.

5. The assembly of claim 1 wherein said sensor assembly includes a light guide and a light sensor where said light sensor is operably coupled to a circuit which in turn is coupled to said power means via a switch, where the signal transmitted by said light sensor to said circuit when in excess of a preset value, closes said switch and thus actuates said heating element.

6. The assembly of claim 1 where the temperature of said elements may be manually modulated.

7. The assembly of claim 1 further including means to deactivate said sensor assembly when light illumination over said surface falls below a preset value.

8. A selective heating assembly comprising:

a substantially planar heating grid operatively coupled to a surface comprised of a plurality of independently heatable elements, where each such element defines an upper and lower surface, where further said heating grid is operatively coupled to one or more sensor assemblies and a power source;

said sensor assembly disposed beneath to said surface so as to be receivable to illumination at a first intensity from a light source disposed above and directed through said surface and about the top surface of said heatable elements in a first condition and at a second intensity when an object is placed on any given heatable elements, where said sensor assembly is adapted to selectively actuate one or more given elements when said sensor assembly is illuminated by said light at a second intensity.

9. The assembly of claim 8 wherein said sensor assembly is comprised of a light guide and an optical sensor where said assembly is adapted to detect variations in light intensity and translate such variations into an electrical signal.

10. The assembly of claim 9 wherein said sensor assembly comprises one or both of a light filter and a transparent cover.

11. The assembly of claim 8 wherein each said heating element is operably coupled to at least one sensor assembly.

12. The assembly of claim 8 wherein said heating elements allow the passage of selected wavelength light therethrough.

13. The assembly of claim 8 wherein said elements are formed from a group including glass or ceramics.

14. The assembly of claim 8 wherein the heating grid comprises a discrete heating means coupled to each heatable element.

15. The assembly of claim 8 where sensor assembly is operably coupled to a circuit which in turn is operably coupled to said power means via a switch such that the signal translated by said sensor assembly to said circuit when in excess of a selected value closes said switch and thus actuates said heating element.

16. The assembly of claim 8 wherein said light source is projected at less than a 60 degree angle with respect to the plane defined by said surface.

17. An assembly comprising:

one or more heating elements arranged about a substantially planar surface, where said elements are operatively coupled to an actuation assembly and a power means, where said assembly and said power means are operatively coupled via on/off circuitry;

said actuation assembly comprising one or more light sources disposed above the heating surface and adapted to direct a beam of light through said surface and across said elements and one or more sensors below the plane defined by the heating surface receptive to said light beam; and said circuit adapted to couple said heating elements to said power means when said sensor receives a fluctuation in illumination emitted by one or more light sources.

18. The assembly of claim 17 where said heating elements comprise a natural gas burner, a feed line, a cut-off valve and a generator and flame element, where said generator and flame element is operably coupled to said circuit by a switch operable via a signal from said sensor.

19. The assembly of claim 17 where said heating elements comprise a resistor-type burner which is operably coupled to said power means via a contactor and a switch, where said switch is operable via a signal from said sensor.

20. The assembly of claim 17 where said sensor is comprised of a light guide and an optical receiver, where said receiver can include a photo resistor, photo diode, photo transistor, photothyristor, or video camera.

21. The assembly of claim 20 where said light guide is provided with a transparent cap which may be composed of glass, glass ceramic, ceramic, fused silica or a combination thereof.

22. The assembly of claim 20 where said light guide is operatively coupled with a light filter and the light sensor, where said light filter is adapted to absorb light of selected wavelengths.

23. The assembly of claim 20 where said light guide includes a fiber optic filament.

24. An assembly comprising:

one or more heating elements disposed about a semi-planar heating surface on which may be placed fluid containing vessels;

a power source;

a sensor assembly operably coupled to said heating elements and said power source via a switch where said sensor assembly is capable or translating fluctuations in light from one or more light sources disposed above the heating surface received thereby to engage or disengage said switch so as to actuate one or more heating elements where further said sensor is disposed below the heating surface.

25. The assembly of claim 24 where said sensor assembly includes means to emit a light beam and means to receive and translate reflections of said light beam into an electrical signal.

26. The assembly of claim 24 where said sensor assembly comprises a light guide and an optical sensor.

27. The assembly of claim 24 where said sensor assembly also includes an internal light source.

28. The assembly of claim 24 where said light guide includes a fiber optic filament.

29. The assembly of claim 24 wherein said sensor is receivable to a light source located above said heating elements.

* * * * *